US010415917B2

(12) United States Patent
White

(10) Patent No.: US 10,415,917 B2
(45) Date of Patent: Sep. 17, 2019

(54) MODULAR FIREARM SOUND SUPPRESSOR COUPLER

(71) Applicant: Sig Sauer, Inc., Newington, NH (US)

(72) Inventor: Ben White, Newington, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 15/956,259

(22) Filed: Apr. 18, 2018

(65) Prior Publication Data

US 2018/0306544 A1 Oct. 25, 2018

Related U.S. Application Data

(60) Provisional application No. 62/489,615, filed on Apr. 25, 2017.

(51) Int. Cl.

| | |
|---|---|
| ***F41A 21/30*** | (2006.01) |
| ***F41A 21/32*** | (2006.01) |
| ***F41A 21/38*** | (2006.01) |
| *F41A 21/34* | (2006.01) |

(52) U.S. Cl.

CPC ..... *F41A 21/30* (2013.01); *F41A 21/325* (2013.01); *F41A 21/38* (2013.01); *F41A 21/34* (2013.01)

(58) Field of Classification Search

CPC ..... F41A 21/30; F41A 21/325; F41A 21/34; F41A 21/38; F41A 21/32; F41A 21/36

USPC ..... 89/14.4, 14.2, 14.3

See application file for complete search history.

(56) References Cited

U.S. PATENT DOCUMENTS

| | | | | |
|---|---|---|---|---|
| 4,588,043 | A * | 5/1986 | Finn | F41A 21/30 181/223 |
| 7,523,581 | B1 * | 4/2009 | Leutenegger | F41A 21/40 42/1.06 |
| 8,286,750 | B1 | 10/2012 | Oliver | |
| 8,453,789 | B1 * | 6/2013 | Honigmann | F41A 21/30 181/223 |
| 8,516,941 | B1 | 8/2013 | Oliver | |
| 8,671,818 | B1 | 3/2014 | Oliver | |
| 8,826,793 | B2 | 9/2014 | Oliver | |
| 9,366,495 | B1 * | 6/2016 | Coppinger | F41A 21/30 |
| 10,119,779 | B1 * | 11/2018 | Miele | F41A 21/30 |
| D837,922 | S * | 1/2019 | McDonald | D22/108 |
| 2011/0186377 | A1 * | 8/2011 | Kline | F41A 21/30 181/223 |
| 2012/0103176 | A1 * | 5/2012 | Latka | F41A 21/30 89/14.4 |
| 2012/0145478 | A1 * | 6/2012 | Brittingham | F41A 21/30 181/223 |
| 2012/0255807 | A1 * | 10/2012 | Pieratti | F41A 21/30 181/223 |

(Continued)

OTHER PUBLICATIONS

"KGmade Suppressors 22 Swarm", 2017, Retrieved from the Internet: URL: https://www.kgmade.net/product-page/22-swarm, [retrieved on Jun. 27, 2018], KGmade Suppressors.

(Continued)

*Primary Examiner* — Joshua E Freeman

(74) *Attorney, Agent, or Firm* — Finch & Maloney

(57) ABSTRACT

Examples include a threaded coupler for connecting two portions of a firearm sound suppressor housing together. The threaded coupler includes a sound suppressing baffle. Using the coupler and its integrated baffle provides additional sound suppression compared to sound suppressors with other types of connectors between housing portions.

17 Claims, 8 Drawing Sheets

(56) References Cited

U.S. PATENT DOCUMENTS

| | | | | |
|---|---|---|---|---|
| 2014/0224574 | A1* | 8/2014 | Latka | F41A 21/30 181/223 |
| 2015/0001002 | A1* | 1/2015 | Wirth | F41A 21/30 181/223 |
| 2015/0135935 | A1* | 5/2015 | Schoenlau | F41A 21/30 89/14.4 |
| 2016/0018177 | A1* | 1/2016 | Powell | F41A 21/30 89/14.4 |
| 2016/0018179 | A1* | 1/2016 | Morris | F41A 21/30 181/223 |
| 2016/0109205 | A1* | 4/2016 | Coppinger | F41A 21/30 89/14.4 |
| 2016/0187093 | A1* | 6/2016 | Barrett | F41A 21/30 89/14.4 |
| 2016/0209151 | A1* | 7/2016 | Smith | F41A 21/30 |
| 2017/0038172 | A1* | 2/2017 | Palu | F41A 21/30 |
| 2017/0097205 | A1* | 4/2017 | Palu | F41A 21/30 |
| 2017/0299314 | A1* | 10/2017 | Palu | F41A 21/30 |
| 2017/0321984 | A1* | 11/2017 | Palu | F41A 21/34 |
| 2018/0023914 | A1* | 1/2018 | Latka | F41A 21/30 89/14.4 |
| 2018/0106569 | A1* | 4/2018 | Smith | F41A 21/30 |
| 2018/0172383 | A1* | 6/2018 | James | F41A 21/30 |
| 2018/0202742 | A1* | 7/2018 | Brittingham | F41A 21/34 |
| 2018/0266783 | A1* | 9/2018 | Morreau | F41A 21/34 |
| 2018/0299223 | A1* | 10/2018 | Barrett | F41A 21/28 |
| 2018/0306543 | A1* | 10/2018 | Tertin | F41A 21/325 |
| 2018/0313625 | A1* | 11/2018 | Tomczak | B23K 33/006 |
| 2018/0340749 | A1* | 11/2018 | Palu | F41A 21/26 |
| 2018/0340750 | A1* | 11/2018 | Mooty | F41A 21/30 |

OTHER PUBLICATIONS

"Oculus22 with ADAPT™ Modular Technology", Retrieved from the Internet: URL: https://ruggedsuppressors.com/product/oculus-22/, [retrieved on Jun. 20, 2018], Rugged Suppressors.

* cited by examiner

MODULAR FIREARM SOUND SUPPRESSOR COUPLER

TECHNICAL FIELD

This application claims priority under 35 USC § 119(e) to U.S. Provisional Patent Application No. 62/489,615 entitled "Modular Firearm Sound Suppressor Coupler," filed on Apr. 25, 2017, which is incorporated by reference herein in its entirety.

TECHNICAL FIELD

The present disclosure relates generally to firearm sound suppressors. Specifically, the present disclosure relates to modular firearm sound suppressor couplers.

BACKGROUND

Firing a projectile from a firearm often involves the use of a propellant (typically a relatively small volume that is on the order of the volume of the projectile itself) that, upon ignition, explodes into a much larger volume of hot gas. The volume of the hot gas can be as much as 100 times, 1000 times, or more, of the volume of the propellant. Confined by the firing chamber, the volume of hot gas forces the projectile from the firing chamber, through a barrel connected to the firing chamber, and out of the firearm.

The ignition of the propellant not only produces a large volume of hot gas, it also produces a loud sound. Sound suppressors, also known as "silencers," are configured to reduce the amplitude of the sound waves produced upon ignition of the propellant. Sound suppressors generally attach to a barrel of a firearm and define: (1) an extension of the firearm barrel for the projectile to pass through and (2) a number of channels for the hot gas to pass through. The channels reduce both the temperature of the hot gas and the speed with which the hot gas is travelling. Reducing these in turn reduces the amplitude of the sound resulting from ignition of the propellant.

SUMMARY

In an example a firearm sound suppressor comprises a coupler comprising a first portion and a second portion opposed to the first portion, the first portion defining first threads and a first surface and the second portion defining second threads and a second surface; and a supplemental baffle disposed within the coupler.

In one embodiment, wherein the first threads and the second threads are defined on an exterior surface of the first portion and the second portion, respectively. In one embodiment, wherein the first threads of the first portion are configured for releasable connection to a first housing of a firearm sound suppressor; and the second threads of the second portion are configured for releasable connection to a second housing of the firearm sound suppressor. In one embodiment, wherein the second threads of the second portion are configured for releasable connection to an end cap. In one embodiment, wherein upon connection to the first housing, the first surface of the first portion is configured to apply a compressive force to an adjacent sound suppression module disposed within first housing. In one embodiment, wherein the first threads are configured for releasable connection to the first housing in a first direction and the second threads are configured for releasable connection to the second housing in a second direction opposite the first direction. In one embodiment, wherein the supplemental baffle disposed within at least one of the first portion and the second portion defines a port configured to permit passage of a projectile.

In an example a firearm sound suppressor comprises a coupler comprising: a first portion integral with a second portion, the first portion defining first threads and a first surface, the second portion defining second threads and a second surface; a supplemental baffle disposed within at least one of the first portion and the second portion; a first housing defining a first portion of a volume having an inside diameter, the first housing comprising: a first end defining first threads configured for releasable connection to a firearm barrel; a second end opposite the first end, the second end defining second threads configured for releasable connection to the first threads of the first portion; and a second housing defining a second portion of the volume having the inside diameter, the second housing comprising: a first end defining third threads configured for releasable connection to the second threads of the second portion; and a second end defining fourth threads.

In an embodiment, an example firearm sound suppressor further comprises a first plurality of sound suppressor modules configured for placement within the first housing and a second plurality of sound suppressor modules configured for placement within the second housing. In an embodiment, wherein the first surface of the first portion is configured to apply a compressive force to a first adjacent sound suppressor module of the first plurality of sound suppressor modules. In an embodiment, wherein each sound suppressor module of the plurality further comprises: a cylinder having an outside diameter less than the inside diameter of the first housing and the second housing; and a baffle disposed within the cylinder. In an embodiment, an example further comprises an end cap configured for releasable connection to the fourth threads of the second housing. In an embodiment, wherein the end cap is configured to apply a compressive force to a second adjacent sound suppressor module of the second plurality of sound suppressor modules.

In an example, a firearm sound suppressor kit comprises a coupler comprising: opposed first and second portions, the first portion defining first threads and a first surface, the second portion defining second threads and a second surface; a supplemental baffle disposed within at least one of the first portion and the second portion; a first housing defining a first portion of a volume having an inside diameter, the first housing comprising: a first end defining first threads configured for releasable connection to a firearm barrel; a second end opposite the first end, the second end defining second threads configured for releasable connection to the first threads of the first portion; a second housing defining a second portion of the volume having the inside diameter, the second housing comprising: a first end defining third threads configured for releasable connection to the second threads of the second portion; and a second end defining fourth threads.

In an embodiment, a firearm sound suppressor kit further comprises a plurality of sound suppressor modules configured for placement within at least one of the first housing and the second housing. In an example, a firearm sound suppressor kit further comprises an end cap.

In an example, a firearm comprising the sound suppressor of any of the preceding examples and/or embodiments.

In an example a method of assembling a sound suppressor comprising: connecting a first end of a first housing to a firearm barrel; disposing at least three sound suppressor modules within the first housing; and connecting a first portion of a coupler to a second end of the first housing, the connected first portion of the coupler providing a compressive force to the at least three sound suppressor modules disposed within the first housing, the coupler including a supplemental sound suppressor baffle.

In an embodiment, an example further comprising connecting an end cap to a second portion of the coupler opposite the first portion of the coupler. In an embodiment, an example further comprising connecting a first end of a second housing to a second portion of the coupler opposite the first portion of the coupler. In an embodiment, wherein connecting the first portion of the coupler to the second end of the first housing comprises engaging complementary threads of the first portion and the first housing in a first direction; and connecting the first end of the second housing to the second portion of the coupler comprises engaging complementary threads of the second portion and the second housing in a second direction opposite the first direction. In an embodiment, an example further comprising disposing at least three additional sound suppressor modules within the second housing. In an embodiment, an example further comprising connecting an end cap to a second end of the second housing.

The figures depict various embodiments of the present disclosure for purposes of illustration only. Numerous variations, configurations, and other embodiments will be apparent from the following detailed discussion.

DETAILED DESCRIPTION

Overview

Embodiments of the present disclosure include a threaded coupler for connecting two portions of a firearm sound suppressor housing together or connecting a first portion of a firearm sound suppressor to an end cap. Typical sound suppressors use a threaded rod to connect housing portions together or use complementary male and female threads integral to a first housing portion and a second housing portion, respectively, that are screwed together.

In some examples the threaded coupler ("coupler" for brevity) includes a sound suppressing baffle. A benefit of using the threaded coupler and its integrated baffle is that the coupler can provide additional sound suppression compared to sound suppressors with conventional connectors between housing portions.

Modular Firearm Sound Suppressor

Figure 1:
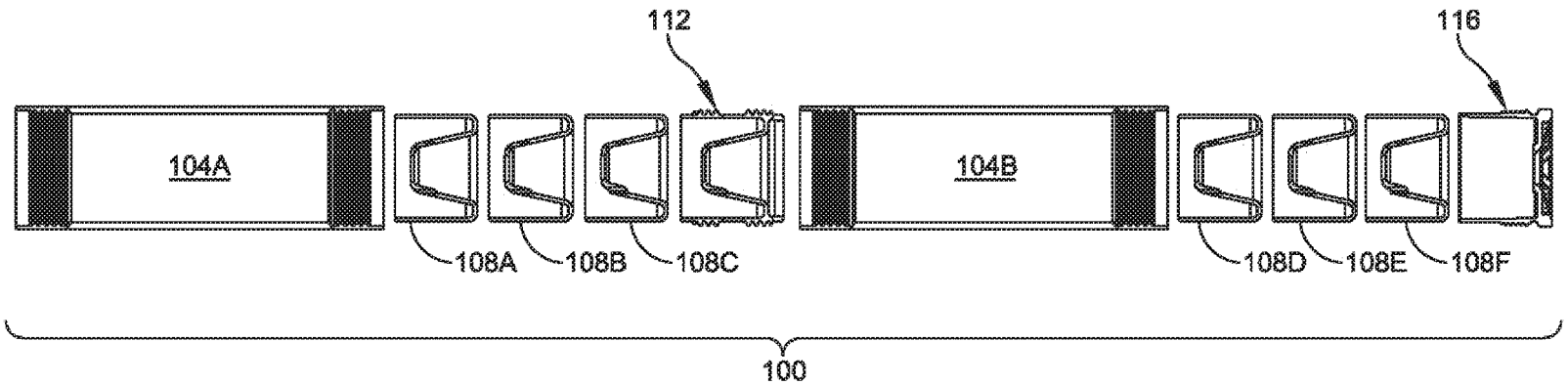
FIG. 1 illustrates an exploded view of a modular firearm sound suppressor, in an embodiment.

FIG. 1 illustrates an exploded view of an example modular firearm sound suppressor 100 of the present disclosure. The example modular firearm sound suppressor 100 includes a first housing 104A, and an optional second housing 104B. The first housing 104A and the second housing 104B are referred to generically or collectively as "housing 104." The modular firearm sound suppressor 100 also includes sound suppressor modules 108A-108F (collectively or generically "module 108"), a coupler 112, and an end cap 116.

Some features of the housing 104 that are integral to each of the housing 104A and the housing 104B are appended with "A" or "B" in some cases to indicate the corresponding housing on which they are formed.

As will be explained in more detail below, in a "short" configuration the housing 104A connects at a first end to a firearm barrel (not shown in FIG. 1). The sound suppressor modules 108A-108C are placed within housing 104A. The coupler 112 is then connected to the housing 104A at a second end. In this configuration, the threaded connection between coupler 112 and housing 104 provides a compressive force, via an adjacent sound suppression module, that causes the modules 108A-108C to form seals with adjacent structures (e.g., the firearm barrel, an adjacent module 108, the coupler 112). The seals force hot gas through the baffles of the modules 108A-108C. These baffles cool and slow the gas, thus reducing the amplitude of sound of the gas. In an example, an end cap 116 may be connected to the coupler 112. In another example, the end cap 116 may be connected directly to the housing 104A.

In a "long" configuration, a first end of the second housing 104B is connected to the exposed threads of the coupler 112, which is attached to the first housing 104A, as described above. Modules 108D-108F are then placed within the second housing 104B. The end cap 116 is connected to a second end of the second housing 104B. The connection between the end cap 116 and the housing 104B thus provides a compressive force that causes the modules 108D-108F to form seals with adjacent structures (e.g., the coupler 112, an adjacent module 108, the end cap 116). Regardless of the configuration, one advantage of these embodiments is the convenient addition of a supplemental sound suppressing baffle (i.e., a fourth baffle in the short configuration or a seventh baffle in the long configuration) integrated into the coupler 112 to the modular sound suppressor 100. This supplemental baffle within the coupler 112 provides additional sound suppression over other types of modular sound suppressors.

Each of these components and configurations is described below in more detail.

Components

FIG. 2A to FIG. 2D illustrate various individual components of the modular firearm sound suppressor 100 of the present disclosure, each of which is described in turn.

Figure 2A:
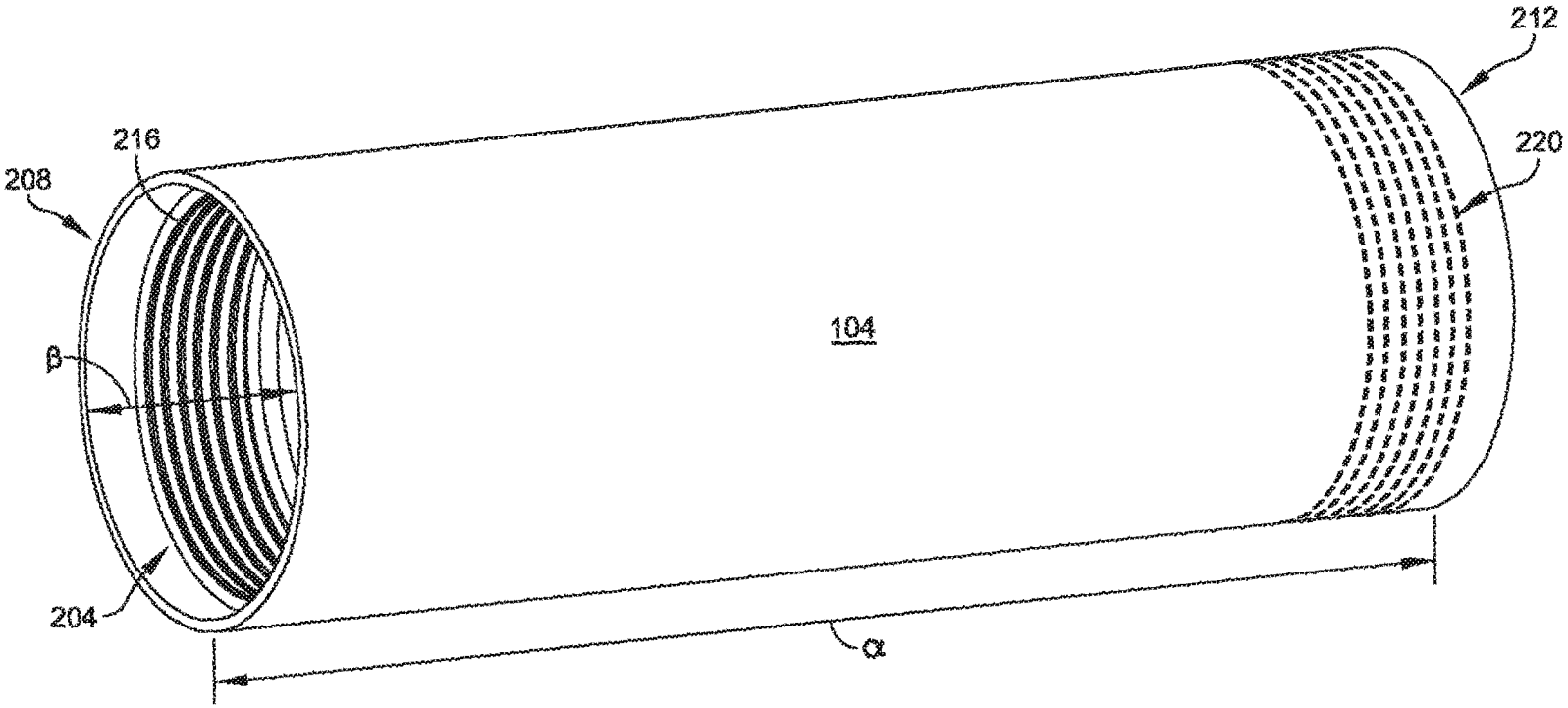
FIG. 2A illustrates a housing of the modular firearm sound suppressor, in an embodiment.

FIG. 2A illustrates a housing 104 of the modular firearm sound suppressor 100. The housing 104A and the housing 104B are similar in configuration in many ways. The housings 104A and 104B may be referred to generically as "housing 104" when describing elements common to both.

As illustrated, the housing 104 is a hollow tube that defines a cylindrical volume 204 within the hollow tube. The housing 104 includes a first end 208 and a second end 212 that is opposite the first end 208. The housing 104 can have a length a between the first end 208 and the second end 212 within any appropriate range, including ranges of: from 1.5 inches to 4 inches; from 1.5 inches to 3 inches; from 1.5 inches to 2 inches; from 2 inches to 4 inches; from 2 inches to 3.5 inches; from 3 inches to 3.5 inches.

In an example, the housing 104A and 104B can have a same length. In another example the housing 104A can have a different length than the housing 104B. A total length of the housing 104A connected to the housing 104B via the coupler 112 can be in any of the following ranges: from 4 inches to 7 inches; from 4 inches to 6.5 inches; from 5 inches to 6.5 inches.

The housing 104 can include an inside diameter β dimensioned to permit placement of (and permit removal of) the modules 108 thereto (and therefrom). The inside diameter β can be within any of the following ranges: greater than 0.5 inches, greater than 0.75 inches, greater than 1.0 inches, greater than 2.0 inches, less than 3 inches, less than 2 inches, and less than 1.5 inches.

The first end 208A and the second end 212A of the housing 104A define internal threads 216A and internal threads 220A, respectively. Threads 216A defined at the first end 208A of the housing 104A are configured to connect to a barrel of a firearm 404 (shown in FIG. 4). Threads 220A at the second end 212A of the housing 104A are configured to connect to a first portion of the coupler 112 proximal to the barrel of the firearm.

Continuing with FIG. 2A, the first end 208B and the second end 212B of the housing 104B define threads 216B and threads 220B, respectively. Threads 216B defined at the first end 208B of the housing 104B are configured to connect to a second portion of the coupler 112 distal to the barrel of the firearm. The threads 220A and 220B may also be configured to connect to an end cap 116.

In examples shown in the figures, the threads 220A and 216B are both female threads that are configured to engage with male threads on corresponding portions of the coupler 112. In another example, the threads 220A and 216B are both male threads that are configured to engage with female threads on corresponding portions of the coupler 112. In still another example, one of the threads 220A and threads 216B is male and the other is female that are configured to engage with corresponding male and female threads of the coupler 112. It will be appreciated that while threads are shown as the connection mechanism used in the figures, other types of connection mechanisms between the housings 104 and the coupler 112 can be used without departing from the scope of the present disclosure.

In an example, the threads 220A at the second end 212A of the housing 104A are configured to tighten in a direction opposite those of the threads 216B of the housing 104B when attached to corresponding threads defined by the coupler 112. This enables a user to grip the housing 104A and the housing 104B and twist each of the housings 104 in opposite directions to simultaneously tighten the connection between each of the housings 104 and the coupler 112.

Figure 2B:
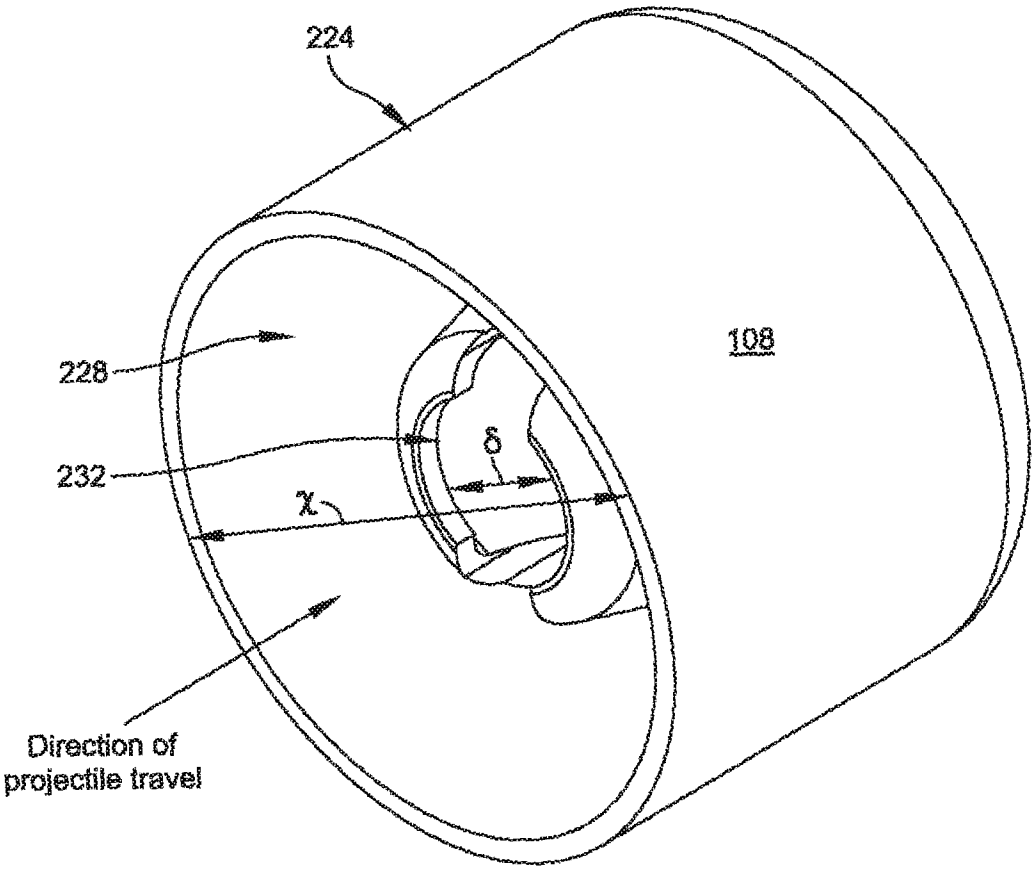
FIG. 2B illustrates an example sound suppressor module, in an embodiment.

FIG. 2B illustrates an example sound suppressor module 108, in an embodiment of the present disclosure. The module 108 includes a cylinder 224 and a baffle 228.

The cylinder 224 and the baffle 228 are integrated in this example so that the cylinder 224 and the baffle 228 act as a single unit. The cylinder 224 has an outside diameter χ selected so that the module 108 can be placed within, and removed from, the housing 104. The outside diameter χ of the cylinder 224 is selected to form a releasable, but tight, fit with the inner diameter β of the housing 104. A tight fit facilitates the channeling of gases released from the ignition of a projectile propellant through the one or more modules 108, thus suppressing sound caused by the ignition of the propellant. The outside diameter χ can be within 1% of the inner diameter of housing 104 and can be within any of the following ranges and selected to form the tight but releasable fit with the housing 104: greater than 0.5 inches, greater than 0.75 inches, greater than 1.0 inches, greater than 2.0 inches, less than 3 inches, less than 2 inches, and less than 1.5 inches.

The baffle 228 in this example is an "M-baffle," although other types of stackable baffle configurations may also be used including, but not limited to, a "K-baffle," and an "Omega baffle." Embodiments of the present disclosure can incorporate any type of baffle configuration or be adapted to accommodate any type of baffle configuration.

Figure 3:
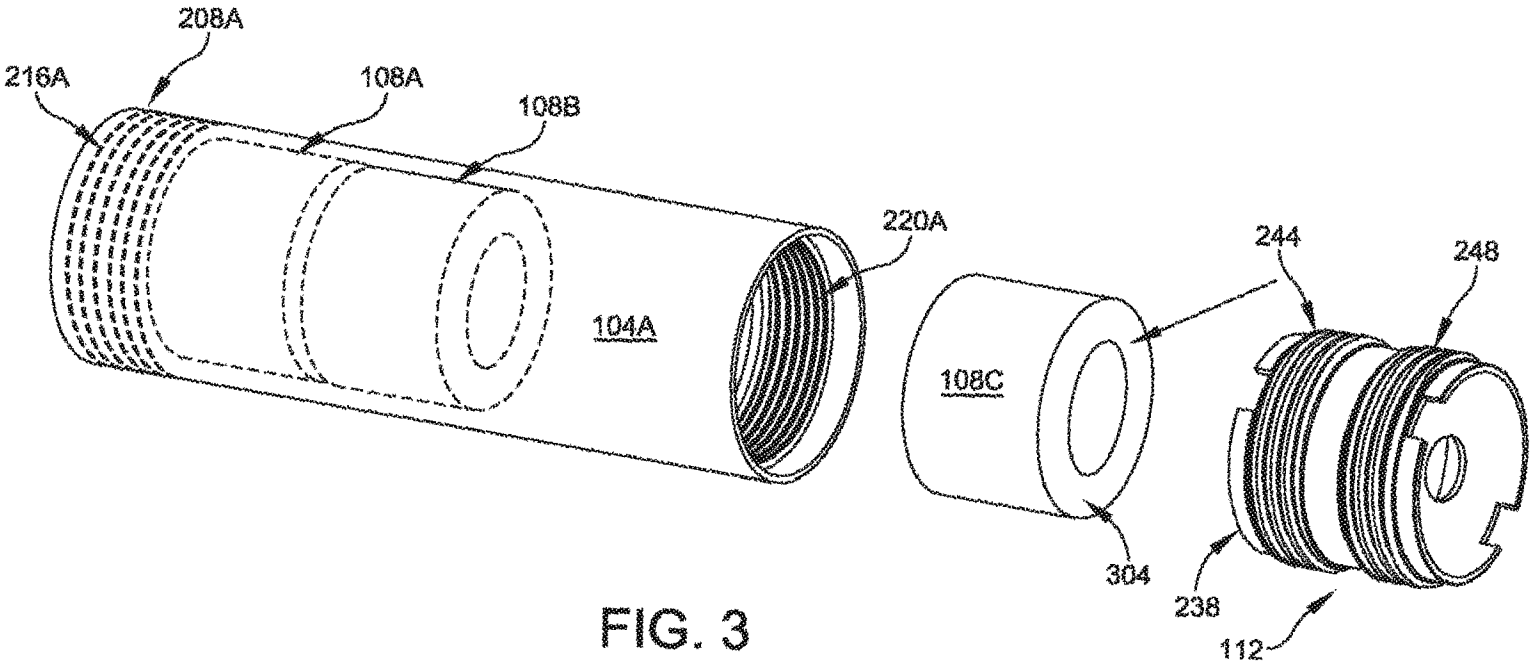
FIG. 3 illustrates a perspective view of a modular firearm sound suppressor in a state of partial assembly, in an embodiment.
Figure 4:
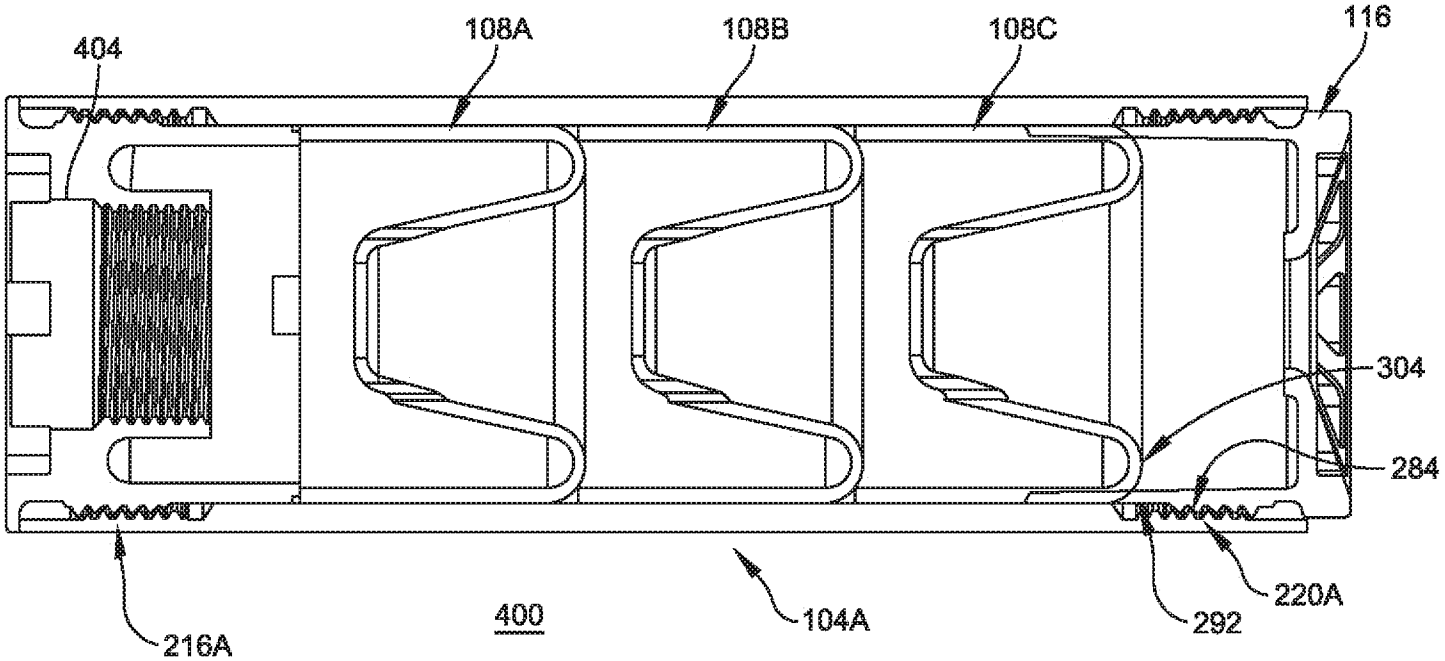
FIG. 4 illustrates a short configuration of a modular firearm sound suppressor without an example coupler, in an embodiment.
Figure 5:
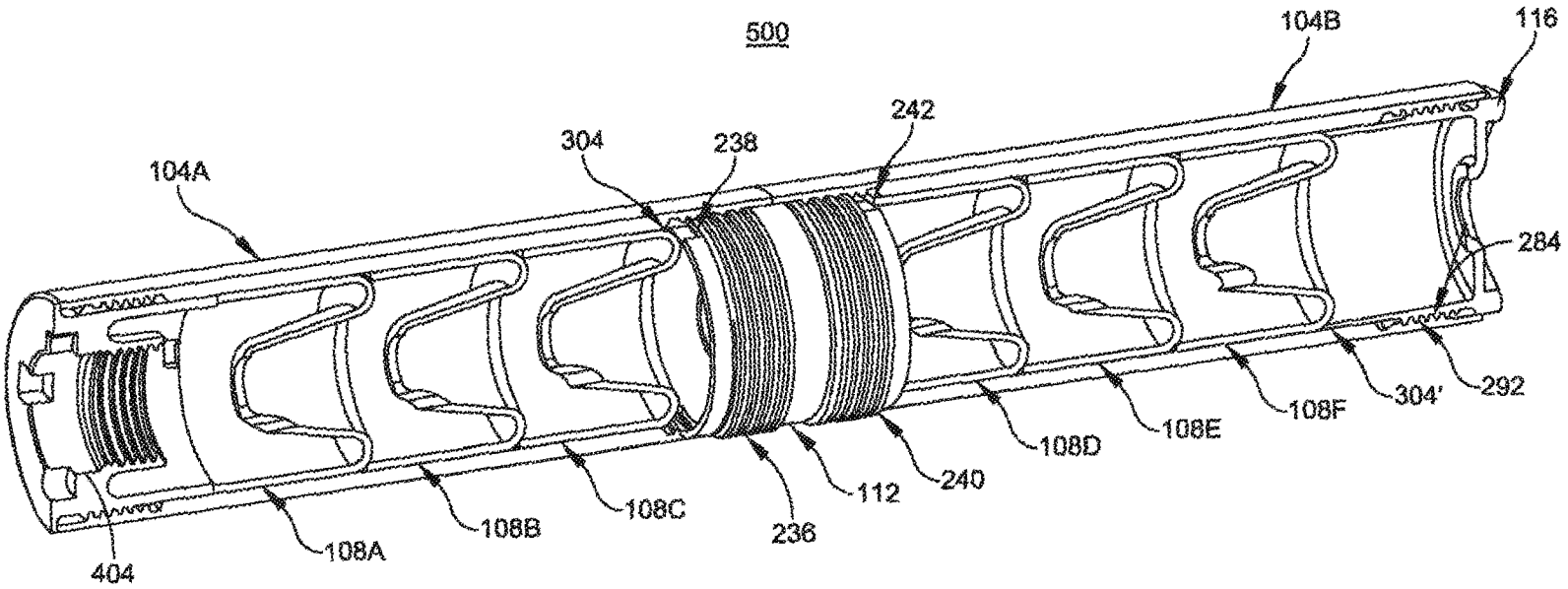
FIG. 5 illustrates a long configuration of a modular firearm sound suppressor, in an embodiment.

Regardless of the type of baffle 228 used, the modules 108 are configured to stack together as shown in FIGS. 3, 4A, and 5 so as to form a seal between any one or more of the housing 104, adjacent modules 108, the coupler 112, and an end cap 116. The baffles 228 associated with the modules 108 and the coupler 112 slow the velocity of the gases and decrease the temperature of the gases, which in turn reduces the sound caused by the ignition.

The baffle 228 also defines a port 232 through which the projectile travels upon ignition of the propellant. The inside diameter δ of the port 232 will be sized according to a caliber of projectile and will be larger than the greatest diameter of the projectile.

Figure 2C:
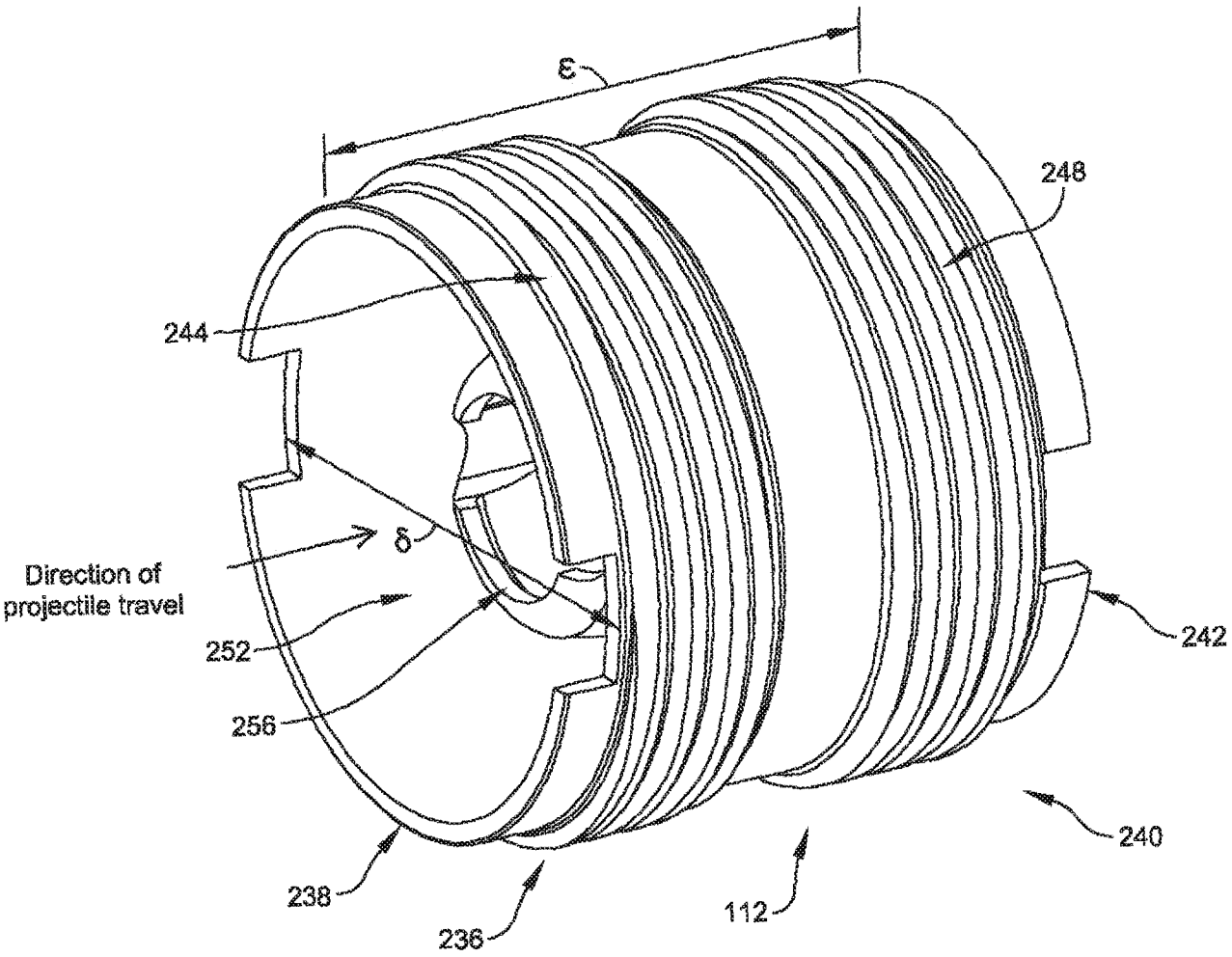
FIG. 2C illustrates an example coupler of the modular firearm sound suppressor, in an embodiment.

FIG. 2C illustrates an example coupler 112 of the modular firearm sound suppressor 100. As indicated above, the coupler 112 performs one or more of at least two functions within the modular firearm sound suppressor 100. First, the coupler 112 can connect the housing 104A to the housing 104B, thus providing a different form of connection between portions of the housing than is conventionally found.

Second, the coupler 112 provides a supplemental (also referred to as an "additional" or an "extra") sound suppressor baffle. This enables an additional sound suppressor baffle to be integrated into the modular sound suppressor 100 than could be accommodated within the individual first housing 104A, the individual second housing 104B, or both of the housing 104A and 104B together when connected using conventional techniques (e.g., a threaded rod or direct threaded connection of 104A to 104B). As with the modules 108, the supplemental baffle 252 integrated within the coupler 112 can be an M-Baffle, a K-Baffle, an Omega Baffle, or any other type of sound suppressor baffle. The integrated supplemental baffle 252 also defines a port 256 that corresponds to the ports 232 defined by the modules 108 that permits passage of a projectile.

The coupler 112 includes a first portion 236 portion that defines a first surface 238 and first threads 244, all of which are integral with the coupler 112 as a whole. The first threads 244 in the example shown are defined on an exterior surface of the first portion 236. The coupler 112 also includes a second portion 240 that defines a second surface 242 and second threads 248, all of which are integral with the coupler 112 as a whole. The first portion and the second portion can be integral with one another. The second threads 248 in the example shown are defined on an exterior surface of the second portion 240

As indicated elsewhere herein, the first threads 244 of the coupler 112 are configured to releasably connect to corresponding threads 220A at the second end 212A of the housing 104A. The second threads 248 of the coupler 112 are configured to releasably connect to one of (1) the threads 216B at the first end 208B of the housing 104B or (2) an end cap. As also indicated above, in an example the directions used to tighten a connected structure to the first threads 244 and the second threads 248 can be opposite. For example, the direction of the first threads 244 can be right-handed and the direction of the second threads 248 can be left-handed, or vice versa. Corresponding threads on the housings 104 are then configured to be compatible with the direction of the first threads 244 and the second threads 248.

The first threads 244 and the second threads 248 are both male threads in the example shown, but as indicated above this is not required.

An outside diameter δ of the coupler 112 is configured to connect to the housing 104 and/or the end cap 116, as described above. The outside diameter δ can be within any of the following ranges: from 0.5 inches to 1.5 inches; from 0.5 inches to 1 inch; from 0.75 inches to 2 inches; from 1 inch to 2 inches.

A length ε of the coupler 112 can be within any appropriate range, including the following ranges: from 0.5 inches to 2 inches; from 0.5 inches to 1 inch; from 0.75 inches to 0.85 inches; from 1 inch to 2 inches.

The coupler 112 can also provide a compressive force to the modules 108 disposed with the housing 104A when engaged with the threads 220A at the second end 212A of the housing 104A. This can be accomplished by engaging the first threads 244 of the coupler 112 with the corresponding threads 220A so that a compressive force is applied by the coupler 112 to the modules 108 disposed within the housing 104A. In one example, the first surface 238 shown in FIG. 2C contacts a confronting surface of an adjacent module 108 within the housing 104A, thus applying a compressive force to the modules 108. In this example, the compressive force encourages formation of a seal between adjacent modules, between the module 108A and the adjacent firearm barrel, and between the module 108C and the coupler 112. As described above, these seals define the gas flow-path through the various baffles of the modules 108 and the coupler 112, thus reducing the velocity and temperature of the gases, which in turn reduces the amplitude of the sound of the ignition.

Figure 2D:
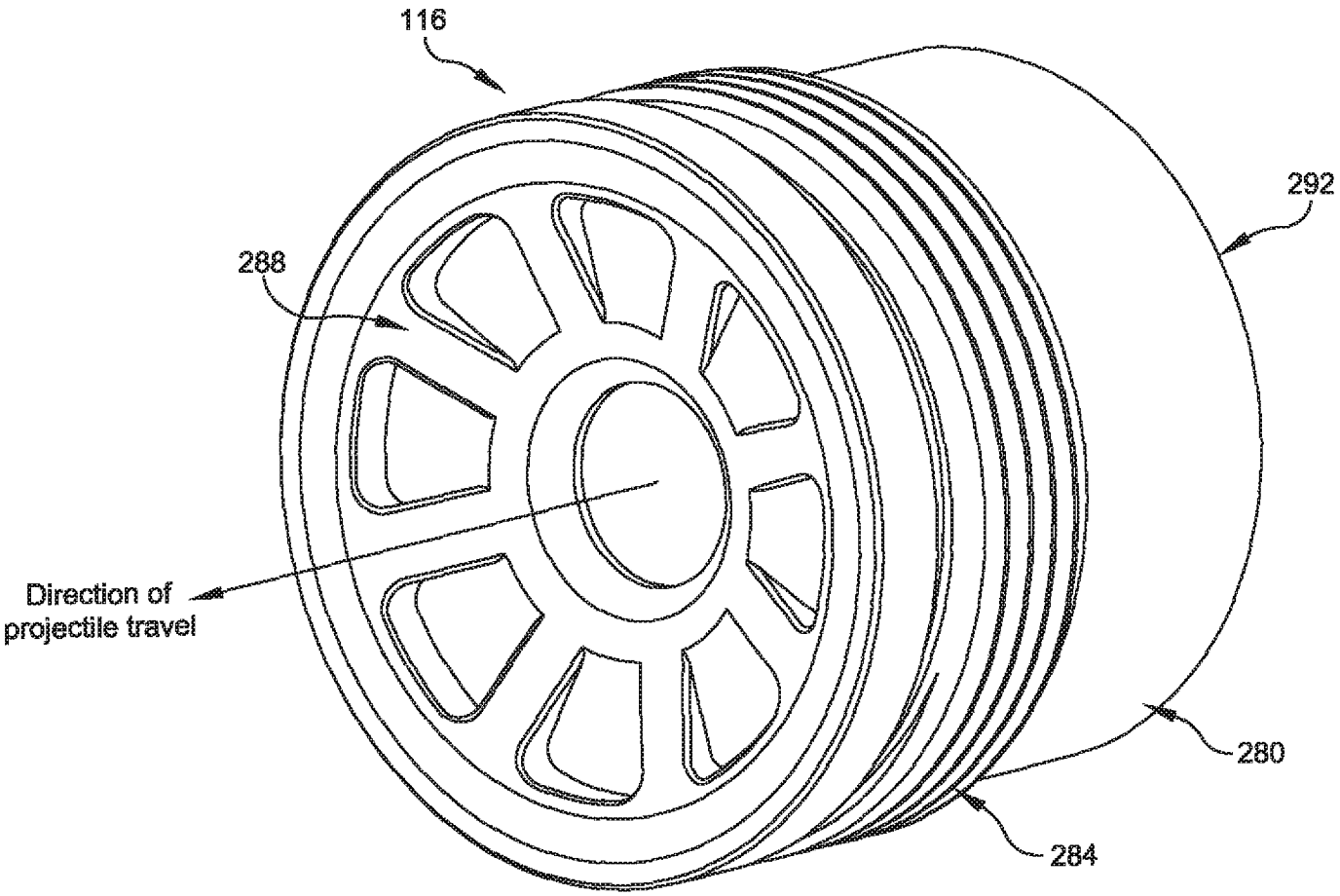
FIG. 2D illustrates a perspective view of an example end cap configured to connect to threads of a coupler or threads of a housing, in an embodiment.

FIG. 2D illustrates a perspective view of an example end cap configured to connect to threads of a coupler 112 or threads 220A, 220B at a second end 212A, 212B of a housing 104A, 104B, respectively, in an embodiment. The example end cap 116 includes an annular body 280, and an occlusive grid 288.

In this example, the annular body 280 defines external male threads 284 that are configured to mount to corresponding threads 220A, 220B illustrated in FIG. 2A. As indicated above, while the threads 284 are shown as external male threads, it will be appreciated that other configurations of threads and other fastening mechanism may also be used so as to enable connection between end cap 116 and any one or more of the threaded coupler 112, the first housing 104A, and the second housing 104B.

The annular body 280 also defines a surface 292 that is configured to confront, in some examples, one of the modules 108. When the surface 292 applies a force to a confronting surface of an adjacent module 108 (i.e., upon engagement of the threads 284 with corresponding threads 220A, 220B), the force compresses the modules 108 and encourages formation of seals between the various components of the modular sound suppressor 100, as described above.

The occlusive grid 288 helps prevent dirt and water (among other contaminants and debris) from entering the assembled modular firearm sound suppressor 100 by reducing a cross-sectional area that is open to an environment.

In some embodiments, a flash suppressor may be substituted for the end cap 116.

The components described above and illustrated in FIGS. 2A-2D may be fabricated from any metal, plastic, or composite used for the fabrication of firearms Assembly FIG. 3 schematically illustrates assembly of various components of the modular firearm sound suppressor 100, in an embodiment. A firearm, connected to the first end 208A of the housing 104A via threads 216A, is omitted for clarity in this figure (but is shown in FIG. 4). Sound suppressor modules 108A-108C are placed within the housing 104A so as to contact one another (modules 108A and 108B are shown in phantom view, having already been placed within the housing 104A).

After placement of the modules 108A-108C, the first threads 244 of the coupler 112 are engaged with the threads 220A of the second end 212A of the housing 104A.

As described above in the context of FIG. 2C, the engagement of the coupler 112 with the housing 104A can apply a compressive force to the modules 108 within the housing 104A. The compressive force comes from contact between the first surface 238 of the coupler 112 and a confronting surface 304 of, in the example shown, the module 108C. The compressive force encourages a seal to form between the modules 108 and adjacent structures (e.g., the coupler 112, the firearm barrel (not shown)).

In an example, an end cap 116 can be attached to the threads 220A of the housing 104A instead of the coupler 112. When attached to the threads 220A, the end cap 116 can apply a compressive force to the modules, rather than the coupler 112. Alternatively, an end cap 116 can be attached to the second threads 248 of the coupler 112. Regardless, both of these examples illustrate a "short configuration" of the modular firearm sound suppressor 100, described below in the context of FIGS. 4A and 4B.

In another example, the housing 104B can be attached to the second threads 248 of the coupler 112. Modules can be inserted into the housing 104B in a configuration analogous to the configuration shown in FIG. 3. The housing 104B can then be capped with an end cap 116 so as to apply a compressive force to the modules 108 therein (i.e., squeezing the modules between the end cap 116 and the coupler 112). This is a "long configuration" of the modular firearm sound suppressor 100, described below in the context of FIG. 5.

Short and Long Configurations

FIG. 4 illustrates one example of a short configuration 400 of the modular firearm sound suppressor 100. In this example 400, the housing 104A is connected to a firearm barrel 404 via the threads 216A of the housing 104A. Modules 108A-108C are placed within the housing 104A as described above. End cap 116 threads 284 are configured to engage with the threads 220A of the housing 104A. The threads 220A and the threads 284 are configured so that the surface 292 of the end cap 116 applies a compressive force to the modules 108A-108C via surface 304, as described above.

In an alternative short configuration of the modular firearm sound suppressor 100, the housing 104A is connected to a firearm barrel 404 via the threads 216A of the housing 104A. Modules 108A-108C are placed within the housing 104A as described above. Unlike the example in FIG. 4, the alternative short configuration is capped with the coupler 112 by attachment of the coupler to the threads 220A, and the end cap 116 is then attached to the coupler 112. In this way, the supplemental sound suppression baffle integrated within the coupler 112 is added to the short configuration compared to the short configuration 400 shown in FIG. 4.

The engagement of the various modules 108 and threads so as to provide a compressive force to the modules 108 has been described above and needs no further explanation. It will be appreciated that the various threads of the housing 104A, the coupler 112, and the end cap 116 may be configured to enable connections in the alternative short configuration. Alternatively, connection mechanisms other than threads may be used.

FIG. 5 illustrates one example of a long configuration 500 of modular firearm sound suppressor of the present disclosure. Similar to configurations described above, the housing 104A is connected to the firearm barrel 404. Sound suppressor modules 108A-108C are placed within the housing 104A. The threads defined by the first portion 236 of the coupler 112 are engaged with the threads 220A of the housing 104A so that the first surface 238 provides a compressive force to the confronting surface 304 of the module 108C. The housing 104B is then connected to the threads defined by the second portion 240 of the coupler 112. Modules 108D-108F are placed within the housing 104B. The housing 104B is then terminated with the end cap 116 by engaging the threads 284 of the end cap 116 with the threads 220B of the housing 104B. The surface 292 of the end cap 116 applies a compressive force to the modules 108D-108F via surface 304', as described above.

As described above, this long configuration 500 includes an additional baffle disposed within the coupler 112, which provides additional sound suppression.

Applications

It will be appreciated that embodiments described herein can be adapted to any of a variety firearm configurations and firearm calibers. For example, embodiments described herein can be applied to long barrel firearms (e.g., rifles, machine guns, shotguns) or short barrel firearms (e.g., pistols, sidearms). Furthermore, embodiments described herein can be applied to any of a number of projectile sizes including, but not limited to: .22 caliber; .38 caliber; .357 caliber; .45 caliber; 9 mm; 10 mm; 5.56 mm; 5.45 mm; 7.62 mm.

SUMMARY

The foregoing description of the embodiments of the disclosure has been presented for the purpose of illustration; it is not intended to be exhaustive or to limit the claims to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the invention, which is set forth in the following claims.

What is claimed is:

1. A firearm sound suppressor comprising:

a coupler comprising a first portion and a second portion opposed to the first portion, the first portion defining first threads and a first surface and the second portion defining second threads and a second surface; and a supplemental baffle disposed within and integral with the coupler.

2. The firearm sound suppressor of claim 1, wherein the first threads and the second threads are defined on an exterior surface of the first portion and the second portion, respectively.

3. The firearm sound suppressor of claim 1, wherein:

the first threads of the first portion are configured for releasable connection to a first housing of a firearm sound suppressor; and the second threads of the second portion are configured for releasable connection to a second housing of the firearm sound suppressor.

4. The firearm sound suppressor of claim 3, wherein the second threads of the second portion are configured for releasable connection to an end cap.

5. The firearm sound suppressor of claim 3, wherein, upon connection to the first housing, the first surface of the first portion is configured to apply a compressive force to an adjacent sound suppression module disposed within first housing.

6. The firearm sound suppressor of claim 3, wherein the first threads are configured for releasable connection to the first housing in a first direction and the second threads are configured for releasable connection to the second housing in a second direction opposite the first direction.

7. The firearm sound suppressor of claim 1, wherein the supplemental baffle disposed within at least one of the first portion and the second portion defines a port configured to permit passage of a projectile.

8. A firearm sound suppressor comprising:

a coupler comprising:

a first portion integral with a second portion, the first portion defining first threads and a first surface, the second portion defining second threads and a second surface;

a supplemental baffle disposed within at least one of the first portion and the second portion;

a first housing defining a first portion of a volume having an inside diameter, the first housing comprising:

a first end defining first threads configured for releasable connection to a firearm barrel;

a second end opposite the first end, the second end defining second threads configured for releasable connection to the first threads of the first portion; and a second housing defining a second portion of the volume having the inside diameter, the second housing comprising:

a first end defining third threads configured for releasable connection to the second threads of the second portion; and a second end defining fourth threads.

9. The firearm sound suppressor of claim 8, further comprising a first plurality of sound suppressor modules configured for placement within the first housing and a second plurality of sound suppressor modules configured for placement within the second housing.

10. The firearm sound suppressor of claim 9, wherein the first surface of the first portion is configured to apply a compressive force to a first adjacent sound suppressor module of the first plurality of sound suppressor modules.

11. The firearm sound suppressor of claim 9, wherein each sound suppressor module of the plurality further comprises:

a cylinder having an outside diameter less than the inside diameter of the first housing and the second housing; and a baffle disposed within the cylinder.

12. The firearm sound suppressor of claim 9, further comprising an end cap configured for releasable connection to the fourth threads of the second housing.

13. The firearm sound suppressor of claim 12, wherein the end cap is configured to apply a compressive force to a second adjacent sound suppressor module of the second plurality of sound suppressor modules.

14. A firearm sound suppressor kit comprising:

a coupler comprising:

opposed first and second portions, the first portion defining first threads and a first surface, the second portion defining second threads and a second surface;

a supplemental baffle disposed within at least one of the first portion and the second portion;

a first housing defining a first portion of a volume having an inside diameter, the first housing comprising:

a first end defining first threads configured for releasable connection to a firearm barrel;

a second end opposite the first end, the second end defining second threads configured for releasable connection to the first threads of the first portion;

a second housing defining a second portion of the volume having the inside diameter, the second housing comprising:

a first end defining third threads configured for releasable connection to the second threads of the second portion; and a second end defining fourth threads.

15. The firearm sound suppressor kit of claim 14, further comprising a plurality of sound suppressor modules configured for placement within at least one of the first housing and the second housing.

16. The firearm sound suppressor kit of claim 14, further comprising an end cap.

17. The firearm sound suppressor kit of claim 14, further comprising a firearm that includes the firearm barrel.

* * * * *